US006138492A

United States Patent [19]

Vining et al.

[11] Patent Number: 6,138,492

[45] Date of Patent: Oct. 31, 2000

[54] TOOL HOLDER FOR PRESS BRAKES

[75] Inventors: James D. Vining, Hugo; John H. Morehead, White Bear Lake, both of Minn.

[73] Assignee: Wilson Tool International, Inc., White Bear Lake, Minn.

[21] Appl. No.: 09/513,375

[22] Filed: Feb. 25, 2000

[51] Int. Cl.[7] ..... B21D 5/02; B21D 37/04

[52] U.S. Cl. ..... 72/481.1; 72/389.3; 72/481.6; 72/482.2; 72/482.6

[58] Field of Search ..... 72/481.1, 481.6, 72/482.2, 482.6, 389.3, 481.9

[56] References Cited

U.S. PATENT DOCUMENTS

| | | | |
|---|---|---|---|
| 5,572,902 | 11/1996 | Kawano | 72/482.91 |
| 5,619,885 | 4/1997 | Kawano et al. | 72/481.8 |
| 5,711,181 | 1/1998 | Mitsuyoshi | 72/389.4 |
| 5,782,308 | 7/1998 | Latten et al. | 72/481.6 |
| 5,794,486 | 8/1998 | Sugimoto et al. | 72/481.3 |
| 6,003,360 | 12/1999 | Runk et al. | 72/482.2 |

*Primary Examiner*—David Jones
*Attorney, Agent, or Firm*—Fredrikson & Byron, P.A.

[57] ABSTRACT

A tool holder for securely holding a forming tool in its intended position on a press brake. The tool holder includes a tool holder plate having first and second receiving surfaces oriented to respectively engage first and second mounting surfaces of a press brake tool, an actuator arm movable toward and away from the tool holder plate and having a camming surface, a clamp carried by the actuator arm and being movable with respect to the actuator arm toward and away from the respective receiving surfaces of the tool holder plate, and a cam surface on the clamp oriented to be engaged by the camming surface of the actuator arm to receive force therefrom in response to engagement of the respective camming surfaces of the actuator arm and the clamp. The force thus received has substantial force vector components normal to the first and second receiving surfaces of the tool holder plate to press against these surfaces, respectively, the first and second mounting surfaces of the tool.

14 Claims, 4 Drawing Sheets

TOOL HOLDER FOR PRESS BRAKES

Field of the Invention

The present invention relates to press brakes of the type used to shape sheet-like metal workpieces. More particularly, this invention relates to workpiece holders used to releasably hold forming tools in a press brake.

BACKGROUND OF THE INVENTION

Press brakes used to shape sheet material, such as sheet metal or the like, commonly include a lower table and an upper table. Typically, at least one of these tables is vertically movable toward the other table. In most cases, the upper table is movable while the lower table remains fixed. Forming means are mounted to each table so that when the tables are brought together, a workpiece between them is bent into the desired shape.

It is common for the upper table to include a male forming tool having a downwardly-oriented, generally V-shaped bottom surface that is configured according to the particular shape into which workpieces will be deformed, and which is received in the V-shaped recess of a die carried by the lower table. Thus, when the tables are brought together, a workpiece between the two is pressed by the forming tool into the die to deform the workpiece into the desired shape. The forming tools and dies commonly are horizontally elongated so that workpieces of various widths can be accommodated. In order to accurately deform workpieces, it is necessary that the forming tool and its respective die be precisely aligned with one another during use.

Various press brake tool holders have been devised to mount a forming tool to an upper table. For example, U.S. Pat. No. 5,782,308 discloses a tool holder with a clamping plate that is pivotally attached to a stationary support plate. During use, a surface of the clamping plate exerts a clamping pressure upon the shank of a forming tool. To keep the tool from falling when the clamping force is released, the clamping plate is provided with an engagement strip that is pretensioned to engage a complementary groove in the tool shank.

The ability of existing press brake tool holders to securely hold forming tools could be improved upon. In many cases, more substantial clamping forces would be beneficial in holding the forming tool in place. Existing tool holders may provide a clamping force that is substantial in the horizontal direction. However, known tool holders commonly fail to provide a clamping force that is substantial in the vertical direction. As a result, unintentional movements of the forming tool can occur during use. As discussed above, this can result in imprecisely deformed workpieces.

It is also important, of course, that the forming tool be easily removed and replaced. It frequently becomes necessary to exchange forming tools and dies in order to accommodate a different bending operation. The dies, commonly resting on the bottom table of a press brake, are readily removed and exchanged for others. On the other hand, the forming tools, which are normally mounted to the upper table of a press brake, tend not to be so easily replaced. The forming tool is often held by a C clamp or a similar holder to the horizontally elongated bed of the upper table.

In some instances, the forming tool can only be removed by sliding it horizontally from the clamp. In other instances, the forming tool can be removed downwardly once the clamp has been loosened. Both removal methods can have drawbacks. In instances where the forming tool is removed by sliding it horizontally from the clamp, removal can be difficult if a long tool must be replaced. The proximity of neighboring clamps and tools can make it difficult to slide the tool from its clamp. The removal of forming tools can also be difficult in instances where a particular tool is removed downwardly. Long forming tools can be quite heavy. When a clamp is loosened to the point where a tool can be removed by moving it downward, the tool may slip and fall.

Tool holders can also be used advantageously as fixtures for tool testing. In this case, one or more forming tools are held in an upwardly-oriented position and are tested to assure each tool is correctly and precisely shaped. For example, a number of aligned forming tools can be easily checked for consistency by assessing whether the forming edges and other surfaces of adjacent tools are precisely aligned with one another. Tool holders may be used in a similar manner to hold forming tools while they are reworked or reconditioned.

A variety of different forming tools can be used with existing press brakes. The forming edge of each tool will vary according to the particular bending operation for which that tool was designed. Furthermore, while the narrow mounting shanks of existing tools tend to have standardized dimensions, slight variations sometimes exist in the dimensions of individual shanks. Such variations can affect the fit of the tool in the tool holder. Accordingly, a tool holder that can accommodate minor variations in tool shank dimension is desirable. Optimally, such a tool holder would be self-adjusting to the shank of each forming tool.

SUMMARY OF THE INVENTION

The present invention provides a tool holder for a press brake tool. The tool holder can be used to hold forming tools that have a body with a mounting tang having a safety slot formed in the surface of a first, commonly vertical, side of the tang and a first mounting surface on an opposite side of the tang. The body of the tool has a second mounting surface forming an included right angle with the first mounting surface.

In accordance with one embodiment of the present invention, the tool holder includes a tool holder plate having first and second receiving surfaces oriented to respectively engage the first and second mounting surfaces of the press brake tool. An actuator arm movable toward and away from the tool holder plate is provided with a camming surface. Carried by the actuator arm is a clamp that is movable with respect to the actuator arm toward and away from the respective receiving surfaces of the tool holder plate. The clamp has a bearing surface adapted to bear against the first surface of the tang and includes a lip shaped to be received in the safety slot of the tang and to engage a confronting surface thereof. A cam surface of the clamp is oriented to be engaged by the camming surface of the actuator arm to receive force therefrom in response to engagement of the respective camming surfaces of the actuator arm and the clamp, the force having substantial force vector components normal to the first and second receiving surfaces of the tool holder plate to press against these surfaces the respective first and second mounting surfaces of the tool.

In accordance with another embodiment of the present invention, there is provided a tool holder and a press brake tool held thereby, the tool having first and second mounting surfaces at right angles to each other and a safety slot. The tool holder includes a support plate with first and second receiving surfaces in respective engagement with the first and second mounting surfaces of the tool. The tool holder includes an actuator arm adjacent to the support plate, the arm having a camming surface. Carried by the actuator arm is a clamp movable toward and away from the respective receiving surfaces of the support plate. The clamp has a surface engaging the first surface of the tang and includes a rib received in the safety slot and engaging a surface thereof. The clamp has a cam surface in engagement with the camming surface of the actuator arm and is oriented to receive force therefrom that has substantial force vector components normal to both the first and second receiving surfaces of the support plate, respectively, to press the first and second mounting surfaces of the tool against the first and second receiving surfaces of the support plate.

DETAILED DESCRIPTION OF THE PREFERRED EMBODIMENT

Figure 1:
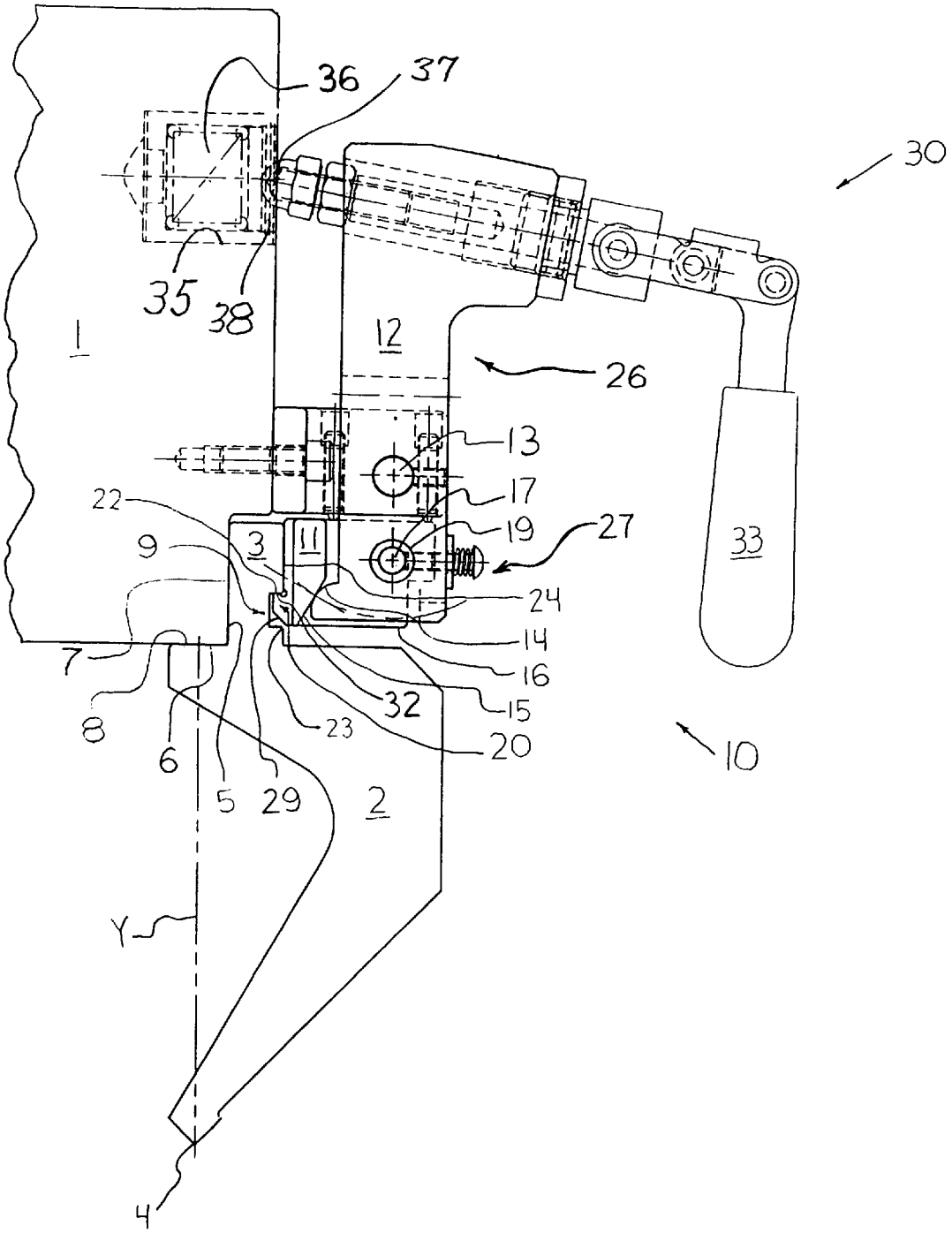
FIG. 1 is an end view of a tool holder depicted in its clamped position according to one embodiment of this invention.

FIG. 1 shows a tool holder 10 according to one embodiment of the present invention depicted in a clamped position about a forming tool 2. This tool holder 10 includes a tool holder plate (or "support plate") 1, an actuator arm 12, and a clamp 11, and it is oriented as mounted to the upper table of a press brake.

The forming tool 2 shown in FIG. 1 is securely held in a vertically aligned position, with its forming edge 4 lying above vertical axis Y. This forming tool 2 has a body with an upwardly extending mounting shank (or "tang") 3 and a downwardly extending bottom area having a "V"-shaped cross-section that terminates at a forming edge 4. There is a safety slot 9 formed in a first side of the mounting shank 3. The body of the forming tool 2 has a first mounting surface 5 that forms an included right angle with a second mounting surface 6. The first mounting surface 5 is vertical and the second mounting surface 6 is horizontal.

The tool holder plate 1 shown in FIG. 1 has a first receiving surface 7 and a second receiving surface 8. These receiving surfaces form a downward and sideward facing shoulder and are adapted to engage the complementary mounting surfaces of the forming tool 2. For example, the tool holder 10 in FIG. 1 is depicted in its clamped position, wherein the first receiving surface 7 of the tool holder plate 1 is engaged with the first mounting surface 5 of the forming tool 2 and the second receiving surface 8 of the tool holder plate 1 is engaged with the second mounting surface 6. In this embodiment, the first receiving surface 7 is vertical and forms a right angle with the second receiving surface 8, which is horizontal. If so desired, however, the tool holder plate can be provided with receiving surfaces at various angles with respect to one another. Likewise, a tool holder plate with more than two receiving surfaces could be provided. Desirably, though, the receiving surfaces of the tool holder plate complement the mounting surfaces of the forming tool. Optimally, the engaged receiving and mounting surfaces have a vertical interface and a horizontal interface. By providing vertical and horizontal interfaces between the forming tool and the tool holder plate, the forming tool can be securely held against the tool holder plate by a clamping force having substantial vertical and horizontal components, as will be discussed later.

The tool holder 10 includes an actuator arm 12 that is movable toward and away from the tool holder plate 1. FIG. 1 shows an actuator arm 12 having a generally elongated shape with upper 26 and lower 27 ends extending respectively above and below a pivot pin 13. The actuator arm may have a variety of different configurations according to various embodiments of the invention. Desirably, the actuator arm 12 is attached to the tool holder plate 1. The actuator arm 12 can be attached to the tool holder plate 1 by any suitable mounting means. In the preferred embodiment illustrated in FIG. 1, the actuator arm 12 is pivotally attached to the tool holder plate 1 by a pivot pin 13. Thus, when the actuator arm 12 is made to pivot, opposed ends thereof move respectively toward and away from the tool holder plate 1.

The actuator arm 12 may, however, be attached to the tool holder plate 1 by other means. For example, in another embodiment of the present invention (not shown), the head of a locking screw extending from the tool holder plate 1 is disposed within a bearing recess in the actuator arm 12 with a certain amount of play so as to form a pivot bearing about which the actuator arm 12 can be made to pivot. Desirably, the actuator arm is provided with at least two such locking screws aligned along an axis about which the actuator arm will pivot. In a slightly different embodiment (not shown), the enlarged, rounded head of a pin extending from the actuator arm 12 is received in a recess in the tool holder plate 1 with a certain amount of play so as to form a pivot bearing about which the actuator arm 12 will pivot. As was the case above, it is desirable to provide the actuator arm with two pins aligned along the pivotal axis of the actuator arm.

In still another embodiment (not shown), a number of projections from the tool holder plate carry screws, pins, or the like that are slidably received in parallel grooves formed in the actuator arm which extend generally away from the tool holder plate. In this embodiment, the entire actuator arm is moveable toward and away from the tool holder plate.

An actuator mechanism linked to the actuator arm 12 is used to move the arm 12 toward and away from the tool holder plate 1. If desired, the entire actuator arm 12 may be movable toward and away from the tool holder plate. Preferably, though the actuator mechanism causes the actuator arm 12 to pivot.

Any suitable actuator mechanism can be used. In the embodiment typified in FIG. 1, the upper end 26 of the actuator arm 12 is linked to a mechanical actuator 30. The illustrated actuator is an over-the-center plunger actuator 10 and comprises a handle 33 which can be urged between an open position (shown in FIG. 2) and a closed position (shown in FIG. 1). When the handle is urged to its closed position, the plunger actuator moves toward a fully extended position. Since the distal end of the plunger actuator is restrained by the tool holder plate, this extension drives the upper end of the actuator arm 12 away from the tool holder plate 1. This in turn causes the lower end of the actuator arm 12 to move toward the tool holder plate 1.

Desirably, there is provided a resilient element through which force is transmitted from the actuator to the clamp 11 so as to accommodate different tool tang thicknesses. A variety of spring-loaded mechanisms may be inserted in the elements through which force is transmitted, using springs or other resilient elements. In the embodiments shown in FIGS. 1 and 2, the tool holder plate is provided with a recess 35 within which is received a coil spring 36, the spring being held in compression between the floor of the recess and a movable spring seat 38 that is positioned to be engaged and depressed by the distal end 37 of the plunger actuator. When an uncommonly wide tool tang is encountered, the lower end 27 of the actuator arm 12 will come to rest in its clamped position further from the tool holder plate 1. Consequently, the distal upper end 37 of the actuator arm 12 will slightly depress the spring seat 38 and will come to rest slightly within the recess in the tool holder plate.

Other mechanical actuators may be used. For example, U.S. Pat. No. 6,003,360, issued to Runk et al. (the teachings of which are herein incorporated by reference), discloses a mechanical actuator that uses a camming action and is useful in the present invention. Here, an oval cam shaft with major and minor axes is rotatably fitted within a bore in a support plate such that rotation of the cam shaft drives the upper end of the clamp away from the support plate. The resultant pivotal motion causes the lower end of the clamp to move toward the support plate.

Non-mechanical actuators may be provided as well. For example, any suitable pneumatic, hydraulic, or electrical actuator may be used in accordance with the various embodiments of the present invention. In any event, the particular actuator used should not be construed as limiting to the present invention.

In accordance with the embodiment shown in FIG. 1, the actuator arm 12 includes a camming surface 14 which faces generally toward the tool holder plate 2. The illustrated camming surface 14 is generally cylindrical in accordance with a preferred embodiment of the present invention. Various suitably configured camming surfaces can be provided in other embodiments. For example, the camming surface may be formed by a generally convex projection from the actuator arm 12. Any suitable surface or edge extending from the actuator arm 12 and facing generally toward the tool holder plate 1 may serve as the camming surface. It is to be understood that the actuator arm may have more than one camming surface. In fact, two aligned but spaced camming surfaces are preferable, as will now be described.

Figure 3:
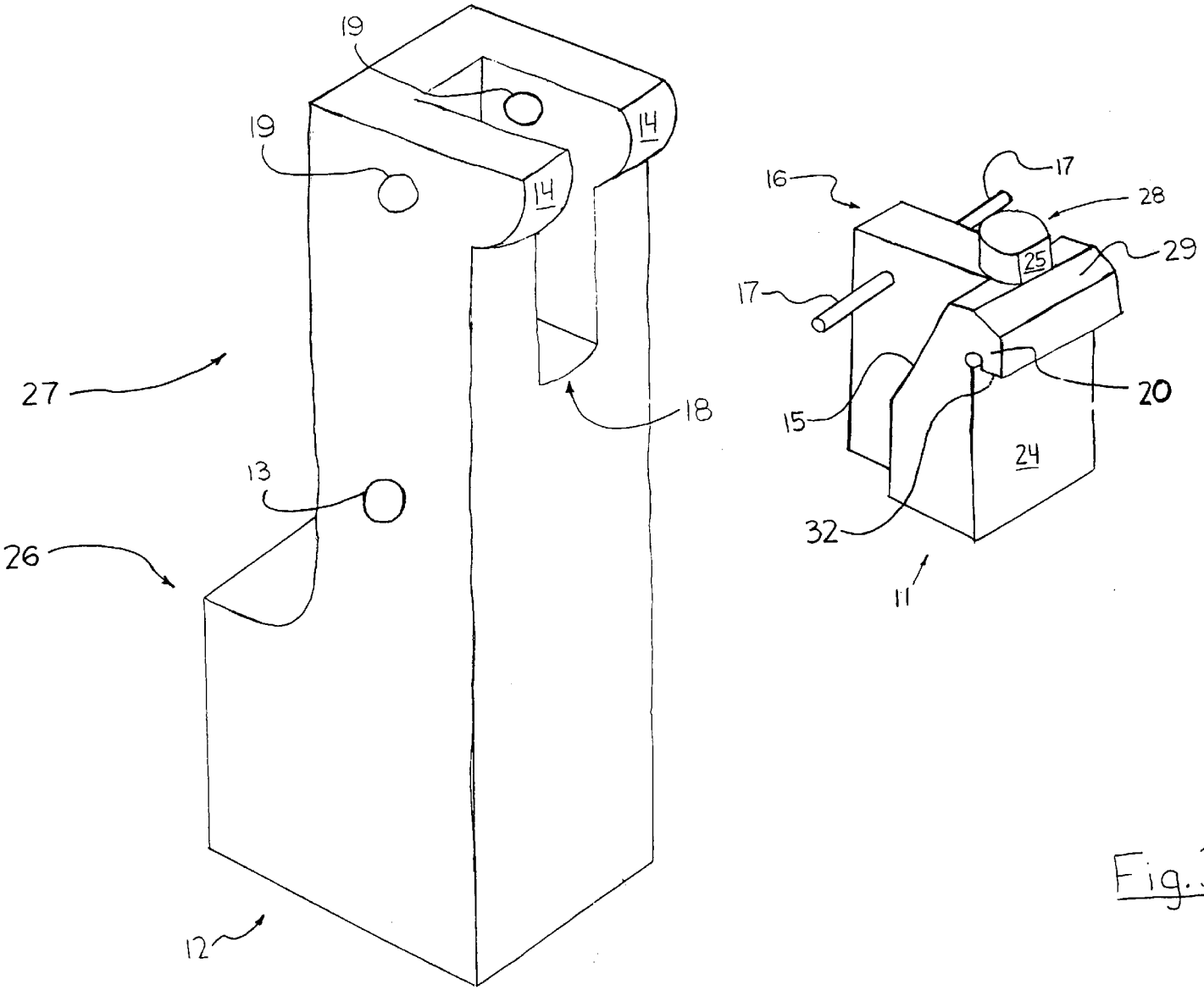
FIG. 3 is an exploded perspective view of a clamp and an actuator arm according to another embodiment of this invention.

The actuator arm 12 illustrated in FIG. 3 includes two parallel spaced camming surfaces 14 that are generally cylindrical and are aligned. Each of the two camming surfaces 14 is formed by an extension of the lower end 27 of the illustrated actuator arm 12. In a preferred embodiment, each camming surface 14 is formed by an integral extension of the actuator arm 12. That is, the actuator arm and each of the camming surfaces may be molded or machined from a single piece of metal. However, if so desired, each camming surface may be formed by a discrete body attached to and extending from the actuator arm. For example, each camming surface may be formed by the convex surface of a dome-shaped body having a planar side attached to the actuator arm. Such a body could be removably attached to the actuator arm by a screw or the like. Alternatively, such a body could be fixedly attached to the actuator arm by welding or the like.

Figure 4:
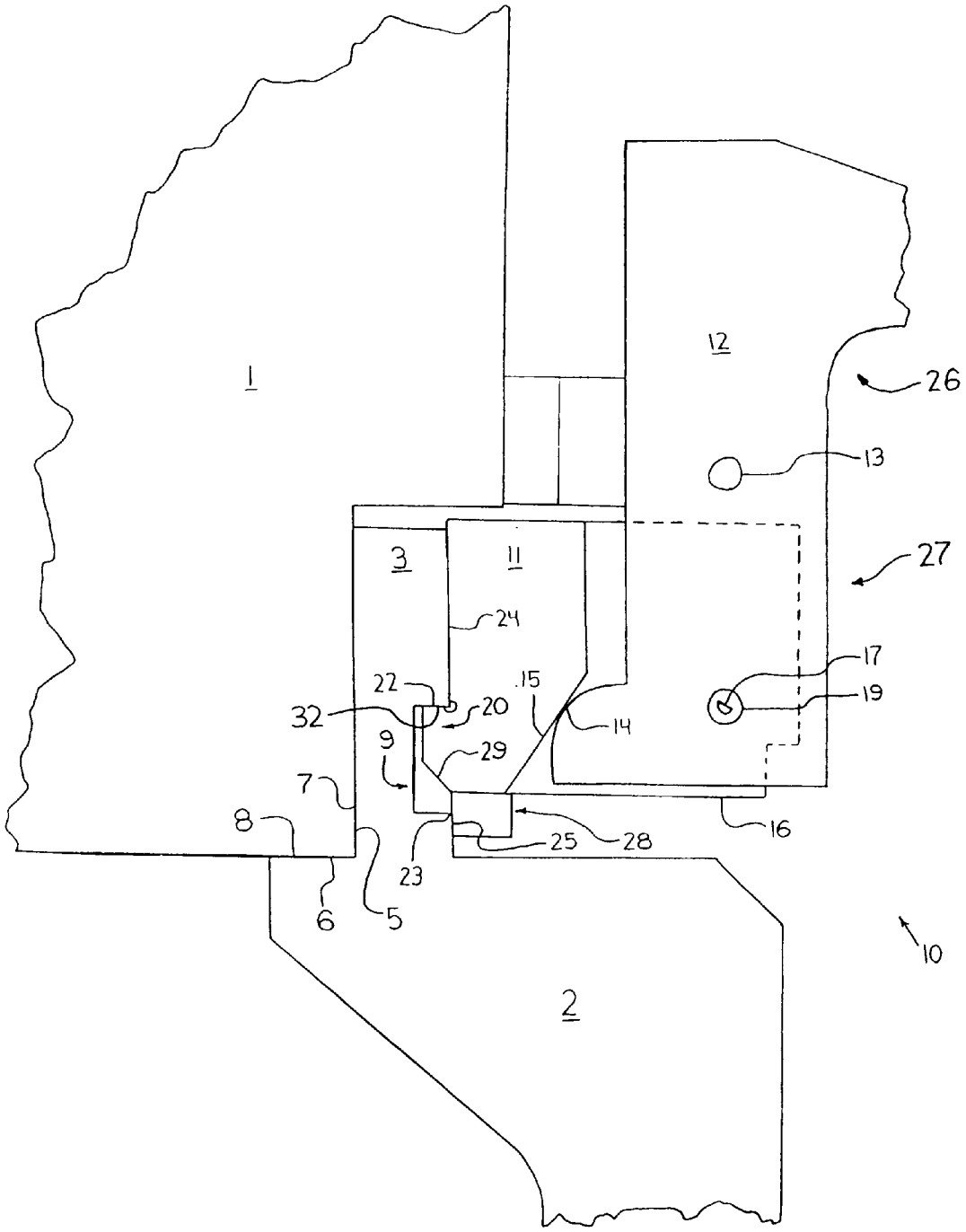
FIG. 4 is an end view of a tool holder depicted in its clamped position and utilizing the clamp and actuator arm of FIG. 3.

As is best seen perhaps with reference to FIGS. 3 and 4, the actuator arm 12 carries a clamp 11 that is mounted to the actuator arm 12. The clamp 11 is movable with respect to the actuator arm 12 toward and away from the respective receiving surfaces of the tool holder plate 1. In a preferred embodiment, the mount also provides the clamp with limited freedom to move rotationally in a vertical plane that is normal to receiving surfaces 7 and 8 of the tool holder plate 1.

With reference to the embodiment illustrated in FIG. 3, the clamp 11 has a narrow body 16 that is received in a slot 18 formed in the lower end 27 of the actuator arm 12. The illustrated slot 18 is open generally toward the tool holder plate 1. The dimensions of the slot can be varied. Desirably, the dimensions of the slot are slightly larger than those of the narrow body so the clamp is moveable within the slot. The narrow body 16 of the illustrated clamp 11 is mounted to the actuator arm 12 by a cross member 17 that is loosely received in apertures 19 formed in the lower end 27 of the actuator arm 12. Desirably, these apertures 19 have an internal dimension greater than the external dimension of the cross member 17, whereby the clamp 11 is provided freedom to move horizontally, vertically, and rotationally in a plane normal to the axis of the cross member. In this embodiment, the degree of freedom given to the clamp 11 is governed by the relative dimensions of the cross member 17 and the apertures 19.

Cross member 17 may have a cross sectional shape that is circular, as shown in FIG. 3, or semi-circular, generally square, generally rectangular, or the like. For example, in one embodiment, an elongated half-round cross member is provided. If so desired, the cross member may be integral in construction with the clamp. That is, the cross member and the clamp may be molded or machined from a single piece of metal. However, in another embodiment, the cross member comprises a discrete member fixedly disposed in and extending from the clamp. In still another embodiment, two discrete cross members are fixedly disposed in and extend from opposed sides of the clamp.

The clamp 11 includes a cam surface 15 that faces generally toward the camming surface 14 of the actuator arm 12. As is perhaps best seen with reference to FIG. 1, the cam surface 15 is generally slanted with respect to the first receiving surface 7 of the tool holder plate 1 in accordance with a preferred embodiment of the present invention. The degree of slant can, of course, be varied. This angle can vary between 15 and 40 degrees, but preferably is approximately 27 degrees to the vertical.

While the description herein exemplifies a singular cam surface, it is to be understood that the clamp may have more than one cam surface. For example, as is best seen with reference to FIG. 3, the clamp 11 preferably has two parallel spaced cam surfaces 15, one formed on either side of the narrow central body 16 of the clamp 11.

The degree of freedom provided to the clamp in different embodiments can be varied as desired. Desirably, though, the clamp is mounted to the actuator arm 12 so that the cam surface 15 of the clamp 11 is kept generally adjacent to the camming surface 14 of the actuator arm 12. This assures that the camming surface and the cam surface can be engaged when the tool holder is urged into a clamped position.

FIG. 1 illustrates an embodiment of the present invention wherein a lip (or "rib") 20 extends from the clamp 11 and is shaped to be received in the safety slot 9 formed in the tang 3 of the forming tool 2. When the tool holder 10 is in the clamped position illustrated in FIG. 1, a surface 32 of the lip 20 engages a confronting surface 22 of the safety slot 9. In the illustrated embodiment, these two surfaces have a generally horizontal interface. Accordingly, a vertical component of clamping force is delivered to the forming tool by the lip of the clamp via this engagement with the confronting surface of the safety slot. In the illustrated embodiment, the lip 20 is an integral extension of the clamp 11. However, if so desired, the lip could be a discrete member extending from and attached to the clamp. For example, such a lip may be welded or bolted to the clamp.

The clamp includes at least one bearing surface that bears against the first side of the mounting tang when the tool holder is in its clamped position. In this position, a horizontal component of clamping force is delivered to the forming tool by the at least one bearing surface of the clamp via its engagement with the first side of the mounting tang. In the embodiment illustrated in FIG. 1, the clamp 11 has a generally vertical bearing surface 24. The illustrated bearing surface 24 bears against a surface on the first side of the mounting tang that is above the safety slot 9. In a preferred embodiment, though, the clamp is also provided with a second bearing surface. In the embodiments shown in FIGS. 3 and 4, the clamp 11 includes a second bearing surface 25 that bears against a surface on the first side of the mounting tang that is below the safety slot 9. As is best seen with reference to FIG. 3, the second bearing surface 25 is formed by an extension 28 from the clamp 11. The illustrated extension 28 has a semi-circular cross sectional shape. If so desired, however, this extension can be generally circular, oval, square, rectangular, or triangular in cross section. The extension 28 may be an integral part of the clamp 11. Alternatively, it may be may be a discrete member fixedly attached to the clamp.

Figure 2:
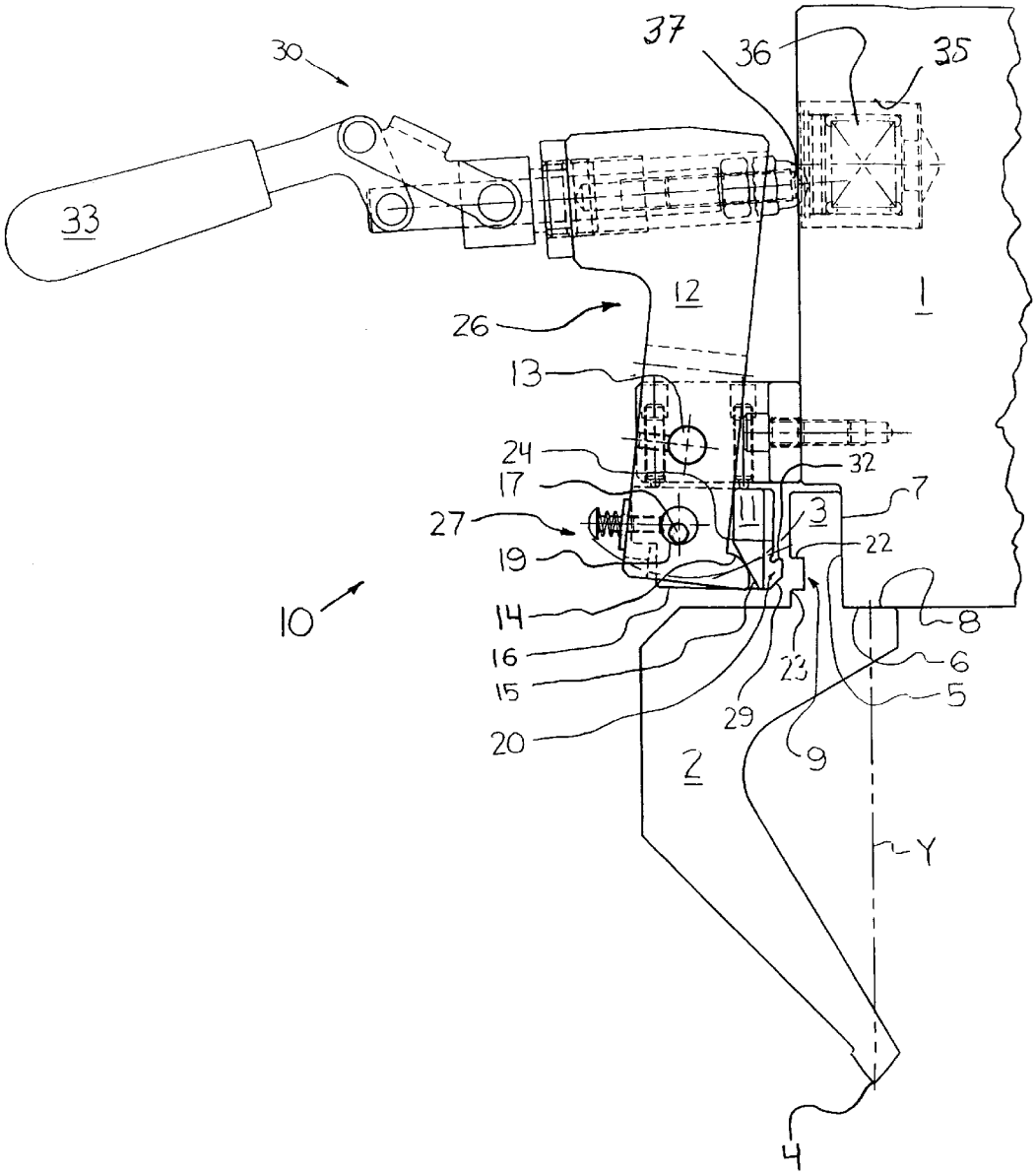
FIG. 2 is an end view of the tool holder shown in FIG. 1 depicted in its unclamped position.

Operation of the tool holder with respect to clamping and unclamping is perhaps best described in connection with the embodiments illustrated in FIGS. 1 and 2.

Manual movement of the handle 30 of the actuator 30 from an open position (shown in FIG. 2), to a closed position (shown in FIG. 1) causes the upper end 26 of the actuator arm 12 to move away from the tool holder plate 1. The resulting pivotal motion of the actuator arm 12 about the pivot point 13 causes the lower end 27 of the actuator arm 12 to move toward the tool holder plate 1. This brings the camming surface 14 of the actuator arm 12 into engagement with the cam surface 15 of the clamp 11. The clamp 11 is thereby urged into engagement with the tang 3 of the forming tool 2.

Because of the freedom of movement afforded the clamp 11, the tool holder is self-adjusting with respect to the dimensions of each forming tool. The configuration of the tool holder complements the standard dimensions of commonly used forming tools. That is, the tool holder is designed so that when the clamp 11 is urged into engagement with the tang 3 of a particular forming tool, the lip 20 of the clamp 11 is generally aligned with the safety slot 9 of the forming tool 2. When the actuator arm 12 is moved toward the tool holder plate 1, the lip 20 of the clamp 11 will naturally settle into the safety slot 9 of the tool 2. If part of the lip 20 extends below the safety slot 9, then the angled leading surface 29 of the lip 20 will engage the bottom outside corner 23 of the safety slot 9. As the clamp 11 is continually urged toward the forming tool 2, the camming engagement of the corner 23 and the angled surface 29 forces the clamp 11 upward, whereby the lip 20 eventually settles into the safety slot 9.

The continued movement of the actuator arm toward the tool holder plate further adjusts and tightens the clamp to the shank of the forming tool. The camming surface 14 of the actuator arm 12 applies a force to the cam surface 15 of the clamp 11. This force has substantial force vector components normal to the respective receiving surfaces (7 and 8) of the tool holder plate 1. The wording "substantial" components is used herein to mean that the force components acting along these vectors are not highly different in magnitude, namely, that each force component has a magnitude that is no more than eight times the magnitude of the other force component.

In the embodiments illustrated in FIGS. 1–4, the applied force has substantial vertical and horizontal components. The horizontal component urges the clamp 11 toward the forming tool 2 until the at least one bearing surface (25 and/or 24) of the clamp 11 engages the first side of the mounting tang 3. Simultaneously, the vertical component urges the clamp upward until a surface 32 of the lip 20 of the clamp 11 engages the confronting surface 22 of the safety slot 9. In this way, the clamp will readily adjust itself to accommodate slight variations in the shanks of different forming tools before coming to rest in a final clamped position.

The tool holder applies a substantially constant clamping force to the shank of the forming tool while in its clamped position. As discussed above, this clamping force has substantial force components normal to the respective receiving surfaces of the tool holder. This allows a forming tool to be held in place on a press brake in a particularly secure manner. Further, the tool holder can be made as wide (measured parallel to the safety slot of the tool) or as narrow as desired, and thus is particularly well suited as a fixture for clamping tools of varying widths to a bench block for testing.

While a preferred embodiment of the present invention has been described, it should be understood that various changes, adaptations, and modifications may be made therein without departing from the spirit of the invention and the scope of the appended claims.

What is claimed is:

1. A tool holder for a press brake tool having a body with a mounting tang, said tang having a safety slot in a first surface thereof and a first mounting surface on an opposite side thereof, said body having a second mounting surface forming an included right angle with said first mounting surface, said tool holder comprising:

a tool holder plate having first and second receiving surfaces oriented to respectively engage the first and second mounting surfaces of said press brake tool;

an actuator arm movable toward and away from said tool holder plate, said actuator arm having a camming surface; and a clamp carried by said actuator arm and movable with respect to the actuator arm toward and away from said respective receiving surfaces, said clamp having a bearing surface adapted to bear against the first surface of said tang and having a lip shaped to be received in the safety slot and to engage a confronting surface thereof, said clamp having a cam surface engagable by said camming surface of said actuator arm to receive force therefrom in response to engagement of the respective camming surfaces of the actuator arm and the clamp, said force having substantial force vector components normal to both said first and second receiving surfaces of the tool holder plate to press the first and second mounting surfaces of the tool respectively against said first and second receiving surfaces of said tool holder plate.

2. The holder of claim 1 wherein said actuator arm is pivotally attached to said tool holder plate.

3. The holder of claim 1 wherein said clamp is movable rotationally in a vertical plane normal to said first receiving surface of said tool holder plate.

4. The holder of claim 1 including a mount mounting said clamp to said actuator arm, said mount comprising at least one cross member extending from said clamp, said at least one cross member being received in apertures formed in said actuator arm, said apertures having an internal dimension greater than an external dimension of said at least one cross member, whereby said clamp is provided with horizontal, vertical, and rotational freedom of movement in a plane normal to an axis defined by said cross member.

5. The holder of claim 1 wherein said first receiving and mounting surfaces are generally vertical and said second receiving and mounting surfaces are generally horizontal, whereby said force has substantial horizontal and vertical force vector components.

6. The holder of claim 1 wherein said cam surface of said clamp is slanted at an angle of between 15 and 40 degrees to the vertical.

7. The holder of claim 1 wherein said cam surface of said clamp is slanted at an angle of approximately 27 degrees to the vertical.

8. A tool holder and a press brake tool held thereby, said tool having a body with a mounting tang having a safety slot in a first surface thereof and a first mounting surface on an opposite side thereof, said body having a second mounting surface forming an included right angle with said first mounting surface, said tool holder comprising:

a support plate with first and second receiving surfaces in respective engagement with said first and second mounting surfaces of said tool;

an actuator arm adjacent to said support plate and having a camming surface;

a clamp carried by said actuator arm and movable toward and away from said respective receiving surfaces, said clamp having a surface engaging said first surface of said tang and having a rib received in said safety slot and engaging a surface thereof; said clamp having a cam surface in engagement with said camming surface of said actuator arm and receiving force therefrom in a direction having substantial force vector components normal to both said first and second receiving surfaces of said support plate and pressing said first and second mounting surfaces of said tool against said first and second receiving surfaces of said support plate, respectively.

9. The holder of claim 8 wherein said actuator arm is pivotally attached to said support plate.

10. The holder of claim 8 wherein said clamp is movable rotationally in a vertical plane normal to said first receiving surface of said support plate.

11. The holder of claim 8 wherein said clamp is mounted to said actuator arm by a mount comprising at least one cross member extending from said clamp, said at least one cross member being received in apertures formed in said actuator arm, said apertures having an internal dimension greater than an external dimension of said at least one cross member, whereby said clamp is provided with horizontal, vertical, and rotational freedom of movement in a plane normal to an axis defined by said cross member.

12. The holder of claim 8 wherein said first receiving and mounting surfaces are generally vertical and said second receiving and mounting surfaces are generally horizontal, whereby said force has substantial horizontal and vertical force vector components.

13. The holder of claim 8 wherein said cam surface of said clamp is slanted at an angle of between 15 and 40 degrees with respect to the vertical.

14. The holder of claim 8 wherein said cam surface of said clamp is slanted at an angle of approximately 27 degrees to the vertical.

* * * * *